United States Patent [19]

Bernier et al.

[11] 4,076,252

[45] Feb. 28, 1978

[54] FLIP TOP AND PLATFORM

[76] Inventors: Harold J. Bernier, 906 W. Travis; Norman F. Daniels, 910 W. Travis, both of Harlingen, Tex. 78550

[21] Appl. No.: 722,794

[22] Filed: Sep. 13, 1976

[51] Int. Cl.[2] ..... A63F 5/04; A63H 1/00

[52] U.S. Cl. ..... 273/141 R; 40/358; 46/65; 273/147

[58] Field of Search ..... 273/141 R, 141 A, 147, 273/128 R, 128 A, 138 R, 58 H, 58 R; 46/64, 65, 73; D34/15 AH, 5 MM, 5 GP, 5 DT; D19/96, 97; 16/1; 40/358

[56] References Cited

U.S. PATENT DOCUMENTS

| | | | |
|---|---|---|---|
| 279,795 | 6/1883 | Pflueger | 40/358 |
| 570,858 | 11/1896 | Waddel | 40/358 |
| 736,751 | 8/1903 | Lobmiller | 40/358 |
| 845,811 | 3/1907 | Osgood | 273/141 R |
| 1,475,975 | 12/1923 | Van Nattan et al. | 273/147 |
| 2,332,507 | 10/1943 | Dailey | 273/147 |
| 2,700,246 | 1/1955 | Ostberg | 46/64 |
| 2,906,057 | 9/1959 | Sullivan | 46/64 |
| 3,843,129 | 10/1974 | Dietrich | 273/128 A |
| 3,863,925 | 2/1975 | Torgow | 46/65 X |

FOREIGN PATENT DOCUMENTS

| | | | |
|---|---|---|---|
| 442,452 | 2/1936 | United Kingdom | 46/64 |
| 803,600 | 10/1958 | United Kingdom | 273/147 |

*Primary Examiner*—Richard C. Pinkham
*Assistant Examiner*—Arnold W. Kramer

[57] ABSTRACT

A game device, that consists of a spinning top, and a concaved dish upon which the top can be spun, the concave dish being radially divided into sectors, each one of which is numbered with a different scoring figure, and the top being transparent and of generally hemispherical shape, with a flat side facing upwardly, wherein an arrow therein is visible for pointing to a scoring figure upon the dish.

2 Claims, 6 Drawing Figures

FLIP TOP AND PLATFORM

This invention relates generally to game devices.

A principal object of the present invention is to provide a flip top and platform, which comprises a novel spinner, and which includes a solid, hemispherical top for spinning upon a point of its hemispherical shape surface, so that a relatively heavy weight thereof provides it momentum for a long spinning action.

Another object of the present invention is to provide a flip top and platform, in which a platform for the top comprises a concaved dish, having radially extending dividing lines, for producing sections, each one of which has a different scoring numeral imprinted thereupon, and wherein, when the top comes to a rest, it is upon a center of the concaved dish.

Yet another object is to provide a flip top and platform, which, accordingly, can be used as a toy for all ages of children, and which is fascinating to observers or participants, because as the top rotates onto its outer edge, it flips upside down.

Still a further object is to provide a flip top and platform, which can be used in conjunction with other games, so as to replace the conventional use of dice, spinning pointers or arrows, which oftentime become broken after a period of use; the present invention being designed as two separate and individual parts, so that there is nothing to break down.

Still another purpose is to provide a flip top and platform in which the top can be alternately spun upon any flat hard surface, other than the concaved dish.

Other objects are to provide a flip top and platform, which is simple in design, inexpensive to manufacture, rugged in construction, easy to use and efficient in operation.

These and other objects will be readily evident upon a study of the following specification, and the accompanying drawing wherein.

Figure 1:
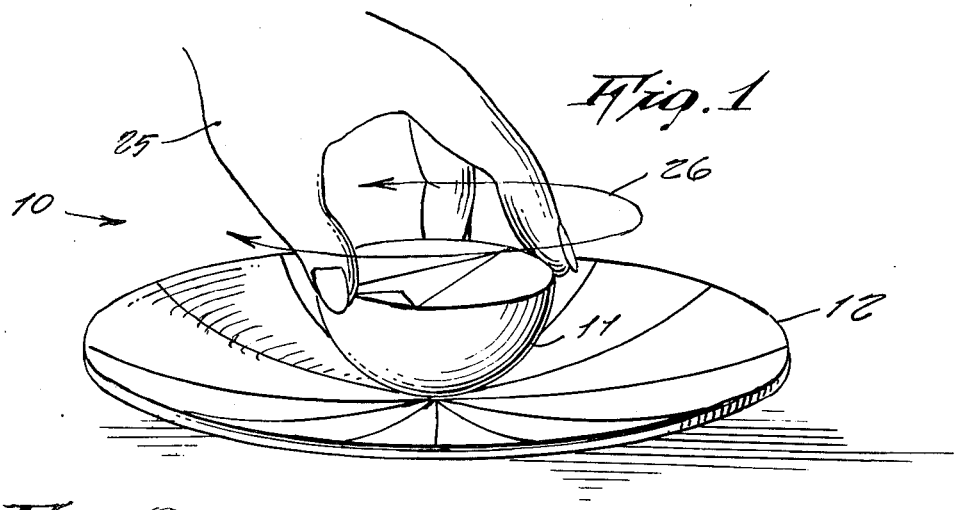
FIG. 1 is a perspective view of the present invention, and showing the top in position ready for spinning.
Figure 2:
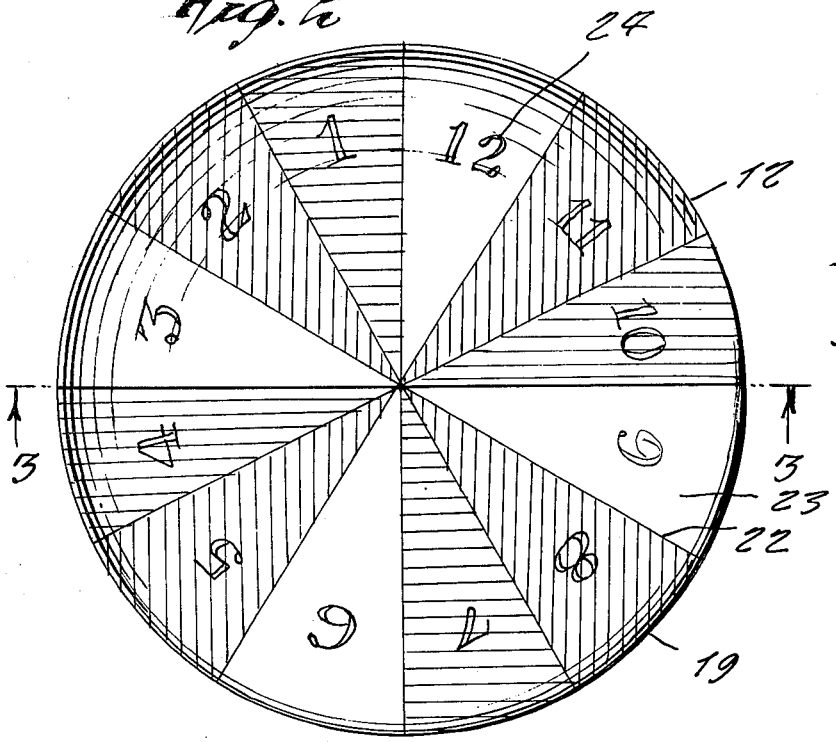
FIG. 2 is a top plan view of the platform.
Figure 4:
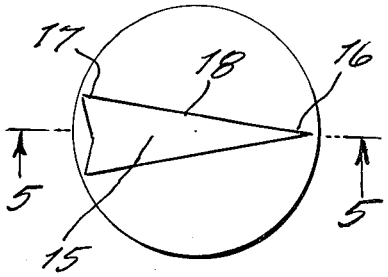
FIG. 4 is a top view of the top.

Referring now to the drawing in greater detail, and more particularly, to FIGS. 1 through 5 at this time, the reference numeral 10 represents a flip top and platform game device, according to the present invention, wherein there is a spinning top 11, and a separate platform 12, each one of which comprises a single part.

Figure 5:
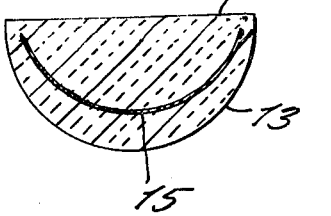
FIG. 5 is a cross-sectional view, taken on line 5—5 of FIG. 4.
Figure 3:
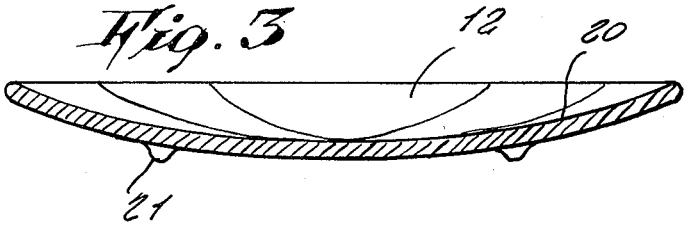
FIG. 3 is a cross-sectional view, taken on line 3—3 of FIG. 2.

The spinning top 11 is generally hemispherical in shape, having a diameter of three inches, and a thickness of one and one-half inch. The top 11 is molded of solid plastic, so as to include a hemispherical surface 13, and a circular flat surface 14. Within the interior of the top, there is molded an arrow 15, which, as shown in FIG. 5, is of arcuate shape, so as to generally follow the contour of the hemispherical surface 13. More particularly, the pointed end 16 and the flaring end 17 of the arrow 15 are closer to the hemispherical surface 13 than a center portion 18 of the arrow, because the arrow has approximately a same sized radial arc as the surface 13 of the top. The top may be made in solid color, multicolored or else clear, as preferred by a manufacturer.

The platform 12 is round in shape, having a rounded edge 19, and includes a concaved upper side, as shown at 20. The underside may be provided with spaced apart feet 21, if so preferred by a manufacturer, so that the platform remains stationary during operative use. The upper surface of the platform is divided, by radially extending lines 22, into a plurality of sections 23, each one of which is imprinted with a different scoring numeral 24. The platform is 9 inches in diameter, being three-quarters of an inch deep of its center. There are 12 pie-shaped sectors 23, as shown, each of which has a different scoring numeral, and each sector is provided with a different colored field than an adjacent sector, as shown. The platform is constructed of plastic. The numerals 24 may be embedded within the plastic, and visible therethrough, or else, alternately, the same may be painted thereupon. So, alternately, instead of numerals, the same may comprise symbols, or written instructions for a particular game.

In operative use, the top is placed upon the platform 12, as shown in FIG. 1, or upon any flat, smooth surface. The top is positioned with the cylindrical surface resting upon the platform. The fingers and thumb of a player's hand 25 are positioned around the flat base of the top. A left or right hand may be used. The top is then spun sharply, in a clockwise or counter-clockwise rotation as shown by arrow 26, by a sharp snap of the hand. Sufficient flip or snap of the top is required, to obtain proper speed of rotation, and as the top moves out of its vertical axis, it continues to rotate until it reaches its outer edge, and flips over. When the top comes to rest, the operation as a toy is complete. When used with the platform, the sector 24, to which the arrow points, is utilized to determine a scoring figure in any game.

Figure 6:
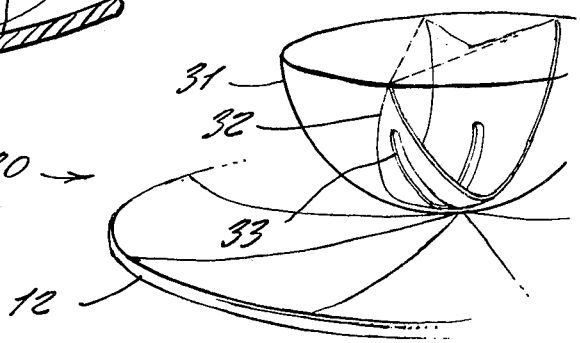
FIG. 6 is a perspective view showing a modified design of the invention.

Referring now to FIG. 6 of the drawing, there is shown a modified design of flip top and platform 30, that utilizes a flip top 31, together with above described platform 12. In this design of the invention, the flip top 31 has an embedded arrow 32, having a central slot 33, so as to permit a person to see therethrough, in order to clearly see on which side of a dividing line 22 the arrow has stopped; and which would eliminate dispute, if the arrow lands on the demarcation line 22 between sectors 23, and which otherwise might be difficult for players to clearly determine.

Thus, different forms of the invention are provided.

While various changes may be made in the detail construction, it is understood that such changes will be within the spirit and scope of the present invention, as is defined by the appended claims.

What I claim is:

1. In a flip top and platform, the combination of a top of hemispherical shape and a circular platform that is downwardly dished for spinning said top thereupon; said top including a hemispherical surface and a flat circular end, said top being molded of transparent, solid plastic and containing an arrow molded therewithin; said platform being divided into twelve sectors, each defined with a different scoring numeral.

2. The combination as set forth in claim 1, wherein said arrow includes a central slot.

* * * * *